United States Patent [19]

Halvorsen

[11] Patent Number: 4,805,585

[45] Date of Patent: Feb. 21, 1989

[54] RADIUS DRESSING APPARATUS

[75] Inventor: James V. Halvorsen, Springfield, Vt.

[73] Assignee: Bryant Grinder Corporation, Springfield, Vt.

[21] Appl. No.: 87,813

[22] Filed: Aug. 19, 1987

[51] Int. Cl.[4] ..... B24B 53/00

[52] U.S. Cl. ..... 125/11 R; 125/11 A; 125/11 BS; 125/11 CW; 51/5 D

[58] Field of Search ..... 125/11 R, 11 TP, 11 A, 125/11 B, 11 BS, 11 CW, 11 CD, 11 AS; 51/165.87, 165.88, 5 D, 165.78

[56] References Cited

U.S. PATENT DOCUMENTS

| | | | |
|---|---|---|---|
| 4,023,310 | 5/1977 | Lovely et al. | 51/5 |
| 4,103,668 | 8/1978 | Nishimura et al. | 51/165 |
| 4,115,956 | 9/1978 | Huffman | 51/165.87 |
| 4,274,231 | 6/1981 | Verga | 51/165 |
| 4,603,677 | 8/1986 | Gile et al. | 125/11 |

*Primary Examiner*—James G. Smith
*Assistant Examiner*—Blynn Shideler
*Attorney, Agent, or Firm*—Edward J. Timmer

[57] ABSTRACT

A dresser carried on a pivotal dresser holder arm is adjustable in position relative to the pivot axis of the arm by a computer control unit using closed loop servo feedback from a position transducer to successively dress different radii and/or shapes (convex or concave) onto the same or different grinding wheels.

17 Claims, 6 Drawing Sheets

RADIUS DRESSING APPARATUS

FIELD OF THE INVENTION

The invention relates to apparatus for dressing a grinding wheel and, in particular, to a radius dresser for a grinding machine.

BACKGROUND OF THE INVENTION

U.S. Pat. No. 4,023,310 issued May 17, 1977, to John W. Lovely and Robert N. Hobbs discloses a grinding machine having a wheel dresser with a diamond dresser carried on a pivotal holder arm. The pivotal holder arm is pivotable about a substantially vertical axis to cause the diamond dresser to be moved in a circular arc path against the grinding wheel to dress a circular arc on the working face of the wheel. The diamond dresser is manually adjustable in position on the holder arm to vary the radius of the circular arc path traced by the dresser and thus the radius of the working surface dressed on the wheel.

U.S. Pat. No. 4,603,677 issued Aug. 5, 1986, to Richard H. Gile and Edward C. Bourgoine describes a wheel dresser for effecting orthogonal dressing of a grinding wheel by a diamond dresser. The diamond dresser is mounted on a pivotal holder similar to that of U.S. Pat. No. 4,023,310. Coarse adjustment of the diamond dresser relative to the pivot line or axis of the holder is effected manually by a set screw that slides a dresser support plate relative to the pivotal holder. Fine adjustment of the diamond dresser relative to the pivot line is provided by a manually turned threaded adjustment screw that deflects a plate carrying the diamond dresser. In this way, the radius of the circular arc path of the dresser can be varied.

U.S. Pat. No. 4,103,668 issued Aug. 1, 1978, to Hiedeo Nishimura et al discloses a rotary dresser wheel carried on a compound slide assembly controlled by an electronic control unit.

U.S. Pat. No. 4,274,231 issued June 23, 1981, to James Verega illustrates one or more dresser wheels that move along two different axes relative to the grinding wheel under control of the same automatic CNC unit which controls movement of the grinding wheel and table during grinding operations.

SUMMARY OF THE INVENTION

The invention contemplates a radius dresser apparatus for dressing or truing a grinding wheel wherein a dresser member is carried on a pivotal holder arm and the dresser is adjustable in position on the pivotal holder arm to vary the position of the dresser member relative to the pivot axis of the holder arm. Adjustment of the dresser position is effected by actuator means on the pivotal holder arm controlled by a control computer using a stored dresser program in combination with dresser feedback position signals. The dresser program is correlated with workparts to be ground with different radius-defined surfaces so as to automatically dress one or more grinding wheels with different radius-defined working surfaces for grinding the workparts.

In a typical working embodiment of the invention, the dresser member is disposed on a slide that is movable on the pivotal holder arm. The slide is moved or translated on the holder by means of a worm/worm wheel drive. The worm is driven in turn by a radius setting motor, such as a servomotor, on the grinding machine and under control of the machine CNC unit.

The CNC unit uses a stored dresser program and closed loop dresser position feedback signals from a position transducer associated with the radius setting motor. The output shafts of the radius setting motor and servomotor pivoting the holder arm are nested one inside another and extend through one of the pivot bearings of the holder arm. The output shaft of the radius setting motor terminates in the worm that meshes and drives the worm wheel for dresser position adjustment.

Preferably, the radius setting motor is disposed in a tubular portion of a drive shaft that pivots the dresser holder arm.

The radius dresser apparatus is suitable for automatically dressing a convex or concave radius onto a grinding wheel in accordance with a radius and shape (convex or concave) programmed into the computer numerical control (CNC) of the grinding machine. The CNC unit also controls the motor that pivots the dresser holder arm.

DESCRIPTION OF PREFERRED EMBODIMENTS

Figure 1:
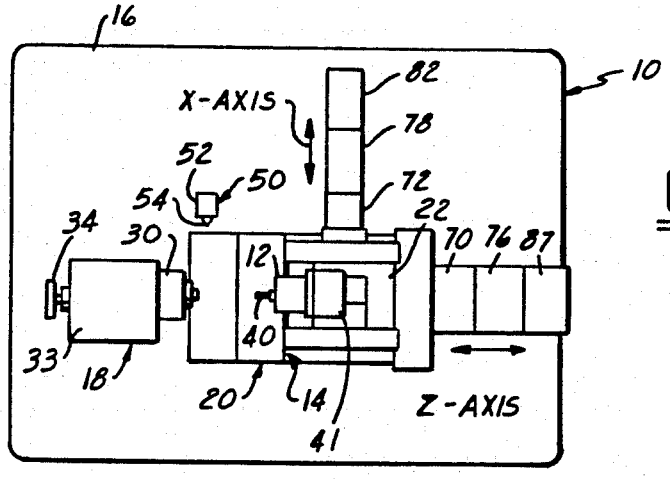
FIG. 1 illustrates schematically a grinding machine to which the invention is applicable.

Referring to FIG. 1, the numeral 10 generally designates a one-station electro-mechanical internal grinding machine with a single grinding wheel spindle 12 on a compound slide assembly 14.

The grinding machine 10 includes a conventional bed or base member 16 on which is operatively mounted a conventional workhead 18. The compound slide assembly 14 is also mounted on the base member 16 and includes a longitudinal or Z-axis slide 20 mounted on base 16 and a cross or X-axis slide 22 operatively mounted on Z-axis slide 20. The wheel spindle can be moved simultaneously in the Z-axis and X-axis directions by slides 20 and 22 as is well known.

The workhead 18 may be of any suitable conventional structure and includes a chucking fixture 30 for holding a workpiece. The chucking fixture 30 may be of the centerless type and rotated by a motor 33 and pulley 34 on the workhead 18.

As shown in Fig. 1, a grinding wheel 40 is operatively held in the spindle 12 which is rotated by motor 41. By movement of the Z-axis and X-axis slides 20 and 22, the grinding wheel 40 can be moved to and from the workpiece held in chucking fixture 30 and into contact with the workpiece; e.g., into contact with an inner bore, to grind same as is known.

The grinding wheel 40 is also movable by the Z-axis and X-axis slides 20 and 22 to and from the dresser apparatus 50 located laterally toward the side of the base member 16. In the embodiment shown in FIG. 1, the dresser 50 includes a support base 52 fixed in position on the base member so that the grinding wheel 40 is brought to and from the dresser apparatus 50 to effect dressing thereof. The dresser will be described in greater detail hereinbelow.

Figure 5:
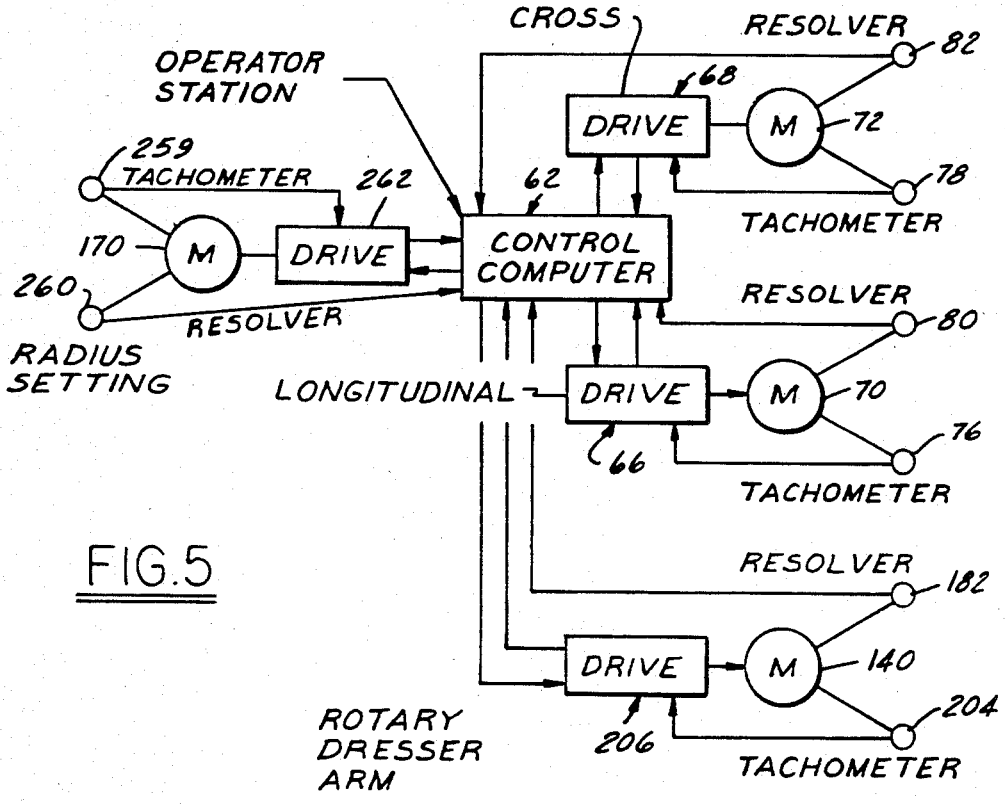
FIG. 5 is a block diagram of an illustrative control system in accordance with the principles of the invention.

FIG. 5 is a block diagram of the control system employed to control movements of the Z-axis and X-axis slides 20 and 22 as well as pivoting of the dresser holder arm and translation of the dresser member to be described below. The numeral 62 generally designates a control computer which is programmed to control all machine functions and interlocks. Such functions include lubrication status, safety interlocks, motor status and operation control station information. The control computer 62 may be any suitable digital computer or microprocessor. The control computer 62 has stored the positions and rates for all the axis moves for the various sequences which may include a grind cycle, dress cycle and so forth. The control computer 62 sends servo drive signals to the servo drive means 66 and 68 for controlling the servo motors 70,72 with respect to the respective Z-axis and X-axis slides to cause the grinding wheel to move in the desired wheel contour path. The servo drive means 66,68 take feedback from the tachometers 76,78 respectively. The numerals 80,82 designate either resolvers, encoders or "INDUCTOSYN" transducers and they provide feed back signals to the control computer 62 in closed servo loop manner, with the tachometers closing inner loops. Reference numerals 80 and 82 could also be laser interferometers or other linear displacement transducers, such as magnetic or optical scales.

A suitable control computer 62 is available on the market from Intel Corp. of Santa Clara, Calif. 95054 and sold under the name of "INTEL" (a trademark) 86/05 Single Board Computer. The servo drive means 66,68 may be any suitable servo drive means as, for example, a servo drive available on the market from Hyper Loop, Inc. of 7459 W. 79 St., Bridgeview, Ill. 60455 under the trademark "HYAMP"- The HYAMP servo drive is a single phase, full wave, bi-directional SCR servo drive for D.C. motors and it provides D.C. drive power for precise speed control and regulation over a wide speed range. Another suitable servo drive designated as Size 50 is available from General Electric Co., 685 West Rio Rd., Charlottsville, Va. 22906. More preferred servo drive means is available from Inland Industrial Drives Div., Kollmorgen Corp., 201 Rock Road, Radford, Va.; model SP/R-X-1152.

The servo motors 70,72 may be any suitable D.C. servo motor. Suitable D.C. servo motors of this type are available from Torque Systems Inc., 225 Crescent St., Waltham, Mass. 02154 under the trademark "SNAPPER" and identified as frame sizes 3435 and 5115. A larger motor of this type is also available from the H. K. Porter Co., 301 Porter St., Pittsburgh, Pa. 15219. More preferred D.C. servo motors are available from Inland Industrial Drives Div. referred to in the preceding paragraph.

The tachometers 76,78 can be part of the D.C. servo motors. The resolvers, encoders or INDUCTOSYN transducer 80,82 are commercially available items and may be any suitable conventional position feedback devices available on the market. Resolvers of this type are available from the Clifton Precision Company of Clifton Heights, Pa. 19018. INDUCTOSYN precision linear and rotary position transducers are available from Farrand Controls, a division of Farrand Industries, Inc., 99 Wall St., Valhalla, N.Y. 10595. A suitable optical shaft angle encoder designated as Model No. DRC-35 is available from Dynamics Research Corp., 60 Concord St., Wilmington Mass. 01887.

The Z-axis and X-axis slides 20,22 are driven and controlled by the control system described above by a conventional ball screw (not shown), Acme screw or other screw means rotated by servo motors 70,72 as explained in U.S. Pat. No. 4,419,612 issued Dec. 6, 1983 of common assignee, the teachings of which are incorporated herein by reference.

The operation of such a grinding machine 10 in the grinding mode under control of a control computer is described in detail in the aforementioned U.S. Pat. No. 4,419,612 incorporated herein by reference hereinabove.

In the wheel dressing mode, the Z-axis and X-axis slides 20,22 are sequenced by the control system described hereinabove to convey the grinding wheel 40 to the dresser apparatus 50 located adjacent the side of the machine on base member 16.

Figure 3:
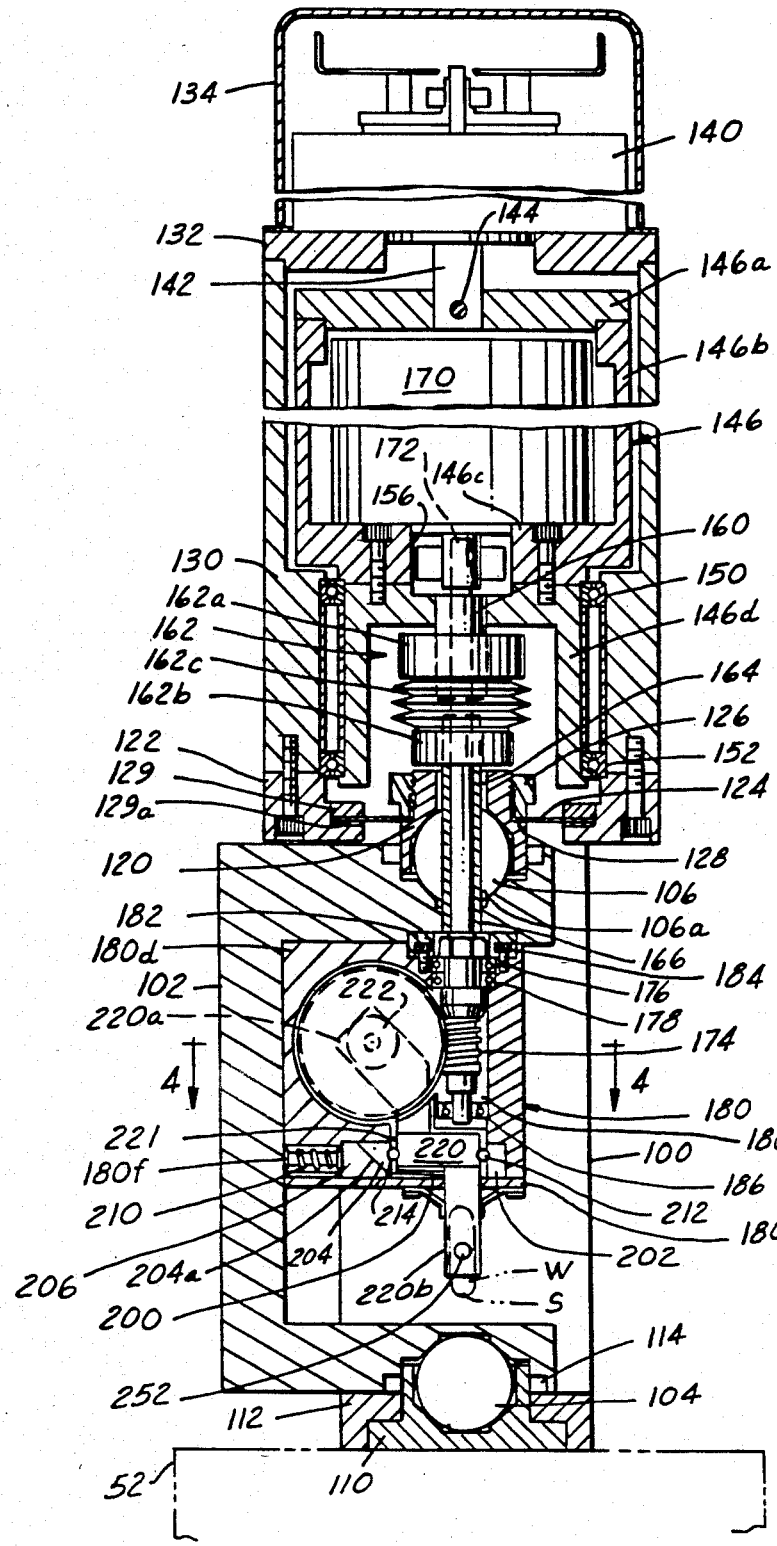
FIG. 3 is a longitudinal sectional view of the dresser apparatus of FIG. 2 along lines 3—3.

The dresser apparatus 50 includes a dresser housing 100 on dresser base 52, FIG. 3. Mounted pivotably on housing 100 is a pivotal or rotatable C-shaped dresser holder arm 102. Dresser arm 102 is pivotably mounted by bottom and top spherical pivot balls or bearings 104,106 so that the dresser arm can be rotated angularly to dress or true a particular convex or concave radius onto a grinding wheel.

Lower ball 104 rests in cup-shaped cylindrical ball seat 110 on base 52. Ball seat 110 is held in position by collar 112 affixed to the base 52 by suitable means. An o-ring seal 114 is provided between the ball seat 110 and pivotal holder arm 102.

Upper ball 106 rests in cup-shaped cylindrical ball seat 120 supported in position from upper housing plate 122 by a annular diaphragm spring 124. As shown, the inner circumference of the spring 124 is clamped fixedly between a threaded collar 126 on the seat 120 and an annular shoulder 128 on the seat 120. The outer circumference of spring 124 is affixed to upper housing plate 122 by ring 129 and shim 129*a* and suitable screws not shown.

Upper housing plate 122 is affixed to vertically extending upper housing tube 130. Housing tube 130 is closed off at its upper end by tube cover plate 132. On tube cover plate 132, a secondary upper housing 134 is affixed and encloses a dresser arm rotation motor 140. Motor 140 preferably is a TTR-2041-XXXX-D-400 motor purchased from previously mentioned Inland Industrial Drives Division of Kollmorgen Corp.

Dresser arm rotation motor 140 includes an output shaft 142 coupled as by pin 144 to tubular shaft 146 comprised of top plate 146*a*, tube 146*b*, and bottom plate 146*c*. Rotation of output shaft 142 thus causes rotation of tubular shaft 146.

Tubular shaft 146 also includes a lower cylindrical sleeve extension **146*d* journaled in axially spaced apart anti-friction bearings 150,152. As is apparent, bearings 150,152 are disposed between sleeve extension 146*d* and the inner cylindrical wall of upper housing tube 130**.

Sleeve extension **146*d* is fixedly fastened to bottom plate 146*c*** by any suitable means such as machine screws.

Bottom plate **146*c* and extension 146*d* include an axially extending hole 156 extending along the longitudinal axis of the motor output shaft 142. A hollow cylindrical stub shaft 160 is affixed to extension 146*d* and depends therefrom along the longitudinal axis of the output shaft 142. The lower end of stub shaft 160 is affixed in a coupling 162 comprising upper coupling collar 162*a*, lower coupling collar 162*b* and stiff coupling bellows 162*c* affixed between the coupling collars. Affixed in the lower coupling collar 162*b* is a second hollow stub shaft 164 that extends along the aforesaid longitudinal axis (i.e., is coaxial therewith) through a bore 106*a* in pivot ball 106 and a bore 166 in the pivot dresser holder arm 102. The end of the stub shaft 164 is affixed in bore 166 by press fit or other suitable means so that rotation of output shaft 142 of dresser rotation motor 140 causes the holder arm 102** to rotate.

As shown best in FIG. 3, a radius setting motor 170 is enclosed within the tubular shaft 146 and is supported by bottom plate **146*c* thereof. The motor 170** preferably is a 1442-007 motor purchased from Harowe Servo Controls, Inc., Westtown Road, West Chester, Pa. 19380.

The radius setting motor 170 includes an output shaft 17 that extends through hollow stub shaft 160, coupling 162 and stub shaft 164. Output shaft 172 is connected at its lower end to a worm gear 174 rotatably supported on the holder arm 102 by a pair of preloaded worm support cylindrical annular bearings 176,178 in a support frame 180 affixed on the arm 102.

Support frame 180 includes a bottom plate **180*a*, front plate 180*b*, rear plate 180*c* and central support block 180*d* therebetween. As shown best in FIG. 3, central support block 180*d* includes a cylindrical bore receiving bearings 176,178 and a retaining collar 182 is fastened to block 180*d* by multiple machine screws 184 to retain the bearings in position. Block 180*d* is provided with an axially extending bore 180*e* in which the worm gear 174 is received with clearance for rotation therein. A cylindrical annular anti-friction bearing 186 rotatably supports the lower end of the worm gear in bore 180*e* as shown in FIG. 3**.

A dresser carriage or slide 200 is slidably supported on the block **180*d* and includes a first side guide rail member 202 and second side guide rail member 204 extending parallel to one another on the support frame 180**.

Second side rail member 204 includes a tapered surface **204*a* that abuts a similar tapered surface on a side wedge member 206. Wedge member 206 is biased to the right in FIG. 3 against side rail member 204 by one or more, preferably multiple, coil springs 210 received in bore 180*f* in block 180*d***.

Figure 2:
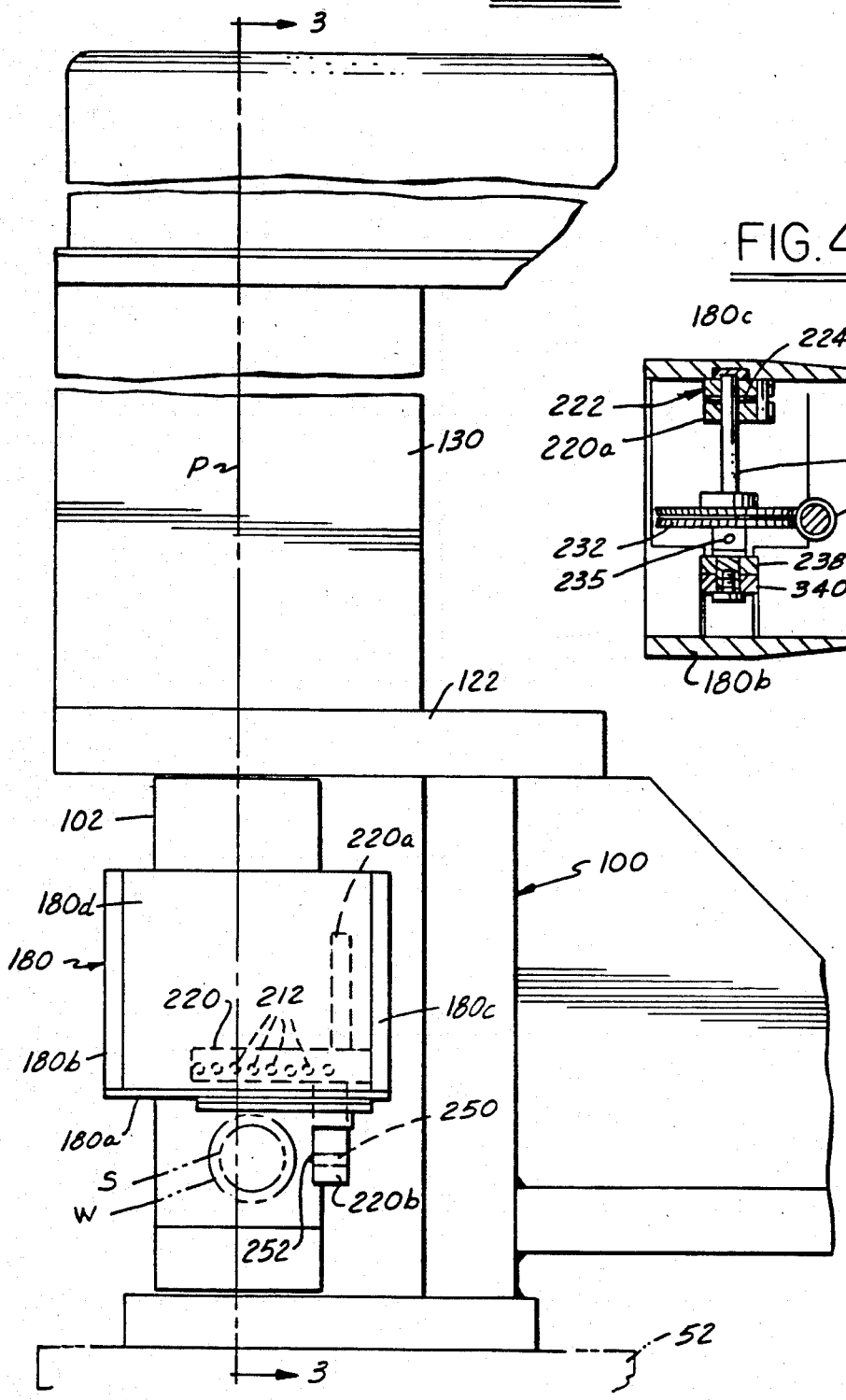
FIG. 2 is a side elevation of the dresser apparatus of the invention.

As shown in FIGS. 2 and 3, a plurality of balls 212,214 are disposed on opposite sides of dresser carriage member 220 between the respective side guide rail members 204,206. The balls 212,214 are contained by a U-shaped cage 221. The balls 212,214 are preloaded by biasing springs 210 biasing side wedge member 206 against side rail member 204 as shown. As a result, lateral play of dresser carriage member 220 transverse to the direction of dresser slide movement on the support block is virtually eliminated.

Figure 4:
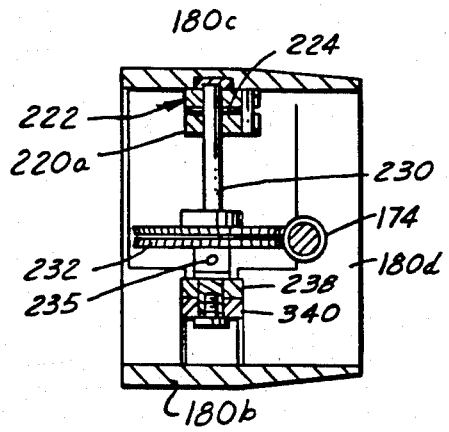
FIG. 4 is a sectional view taken along lines 4—4 of FIG. 3.

Dresser carriage member 220 includes an extension **220*a* that supports a preloaded nut 222 fixed in position on extension 220*a*. Nut 222 is preloaded by spring 224 between itself and extension 220*a* having a threaded inner bore to threadably receive the threaded end of drive screw 230. As shown best in FIG. 4, drive screw 230 carries antibacklash worm wheel 232 which is affixed to the drive screw 230 by pin 235. The other end of the drive screw 230 is rotatably supported by a pair of preloaded screw support bearings 238,240 on block 180*d***.

Thus, when worm gear 174 is incrementally rotated by radius setting motor 170, the worm wheel 232 rotates and drives carriage drive screw 230 to rotate relative to the drive nut 222 on the dresser carriage extension **220*a*. As a result, dresser carriage member 220 is caused to slide one direction or the other on support block 180*d* on holder arm 102** depending upon direction of drive screw rotation.

Dresser carriage member 220 also includes depending extension **220*b* on which a diamond dresser 250 having conical tip 252 is carried and is adjustable in position relative to the pivot axis or line P of the dresser holder arm 102 by sliding of the dresser carriage member 220 on support block 180*d* through the worm/worm wheel drive as actuated by radius setting motor 170**.

When dresser holder arm 102 is pivoted about axis P by dresser rotation motor 140, the dresser tip 252 will be moved in circular arc path the radius of which and shape of which (convex or concave) will depend on the position of the dresser tip 252 relative to pivot axis P.

Dresser rotation motor 140 is a commercially available servo motor that is used in association with a resolver 182 and tachometer 204 that interface with servo drive means 206 through control computer 62 which may be of the known commercially available types described hereinabove, FIG. 5. Servo motor 140 receives servo signals from servo drive means 206. The control computer 62 interfaces with the servo drive means 206 and has input and stored therein control information to provide a desired dresser holder arm pivotal motion about pivot axis P to dress a grinding wheel W having a radius defined working surface S of particular circumferential dimension. Control computer 62 uses the stored control information in combination with servo loop feed back from resolver 182 to control pivotal or incremental rotation of dresser holder arm 102 during dressing of the working face of the grinding wheel to provide the desired partial circumference for the radius-defined working surface.

Control computer 62 also has input and stored therein control information to position the dresser carriage member 220 and dresser tip 252 at a desired position relative to pivot axis P for a particular dimension (radius) and shape of working surface on the grinding wheel W. The dresser tip 252 can be moved automatically by the control computer 62 in accordance with a stored dresser program correlated with a stored workpart program for effecting grinding of different radius-defined surfaces on the same workpart or on different workparts. The operator of the grinding machine would not be required to manually reset the position of the dresser tip 252 as in the past.

To this end, the radius setting motor 170 is a servo motor that includes a tachometer 259 and an encoder or resolver 260 as a dresser feed back position transducer interfacing with servo drive means 262 through control computer 62. Control computer 62 uses the stored dresser control information in combination with servo loop feedback from resolver 260 to control and to adjust the position of the dresser tip 252 on arm 102 relative to pivot axis P so as to dress the same or different grinding wheels with working surfaces defined by different radii. The dressed grinding wheel is of course used to grind the different radius defined surfaces on the same or different workparts. Servo motor 170, servo drive means 262 and encoder 260 can be of the commercially available type described above.

With computer control of the radius setting motor 170 and thus of the position of dresser tip 252 relative to the pivot axis P, a first set of multiple workparts to be successively ground with a certain radius and shape of grinding wheel can be ground followed by a second set of multiple workparts to be successively ground by a wheel with a different radius and/or shape. The dresser tip 252 would be automatically positioned in accordance with a dresser program in the computer control to dress the first wheel radius/shape for the first set of workparts and then repositioned to dress the second wheel radius/shape for the second set of workparts and so on for other workparts to be ground.

FIGS. 6–10 illustrate a preferred embodiment of the invention wherein like features are represented by like reference numerals primed. The primary difference between the embodiment of FIGS. 6–10 and that described hereinabove relates to the location and drive mechanism for the dresser arm rotation motor 140' and radius setting motor 170'.

Figure 7:
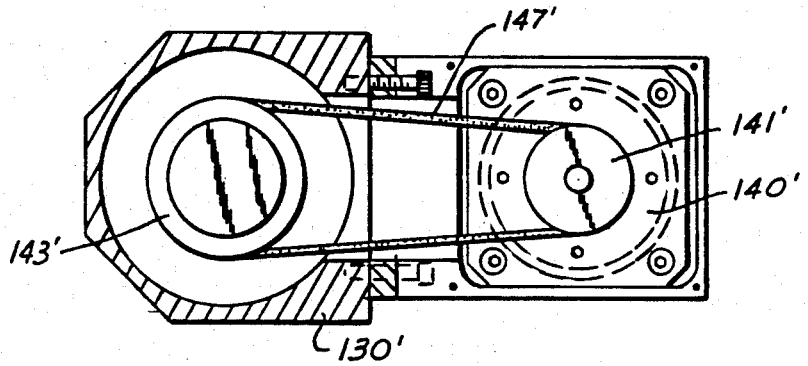
FIG. 7 is a sectional view taken along lines 7—7 of FIG. 6.
Figure 6:
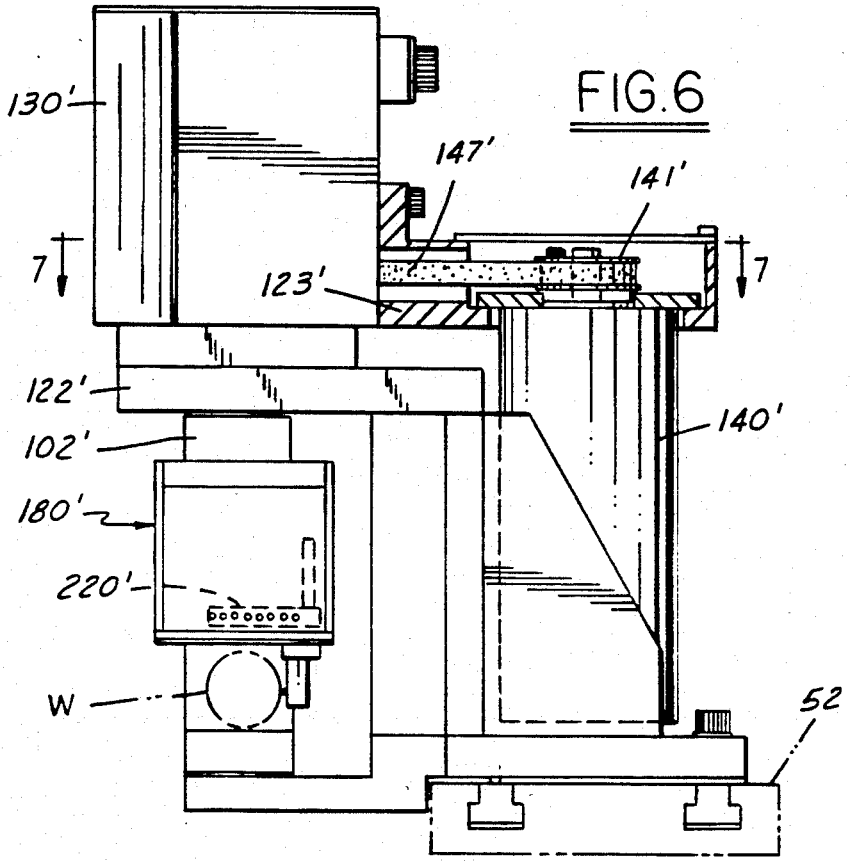
FIG. 6 is a side elevation of another embodiment of the invention having a different motor lay-out for rotating the dresser holder arm and for rotating the worm gear that adjusts the dresser carriage or slide on the holder arm.
Figure 8:
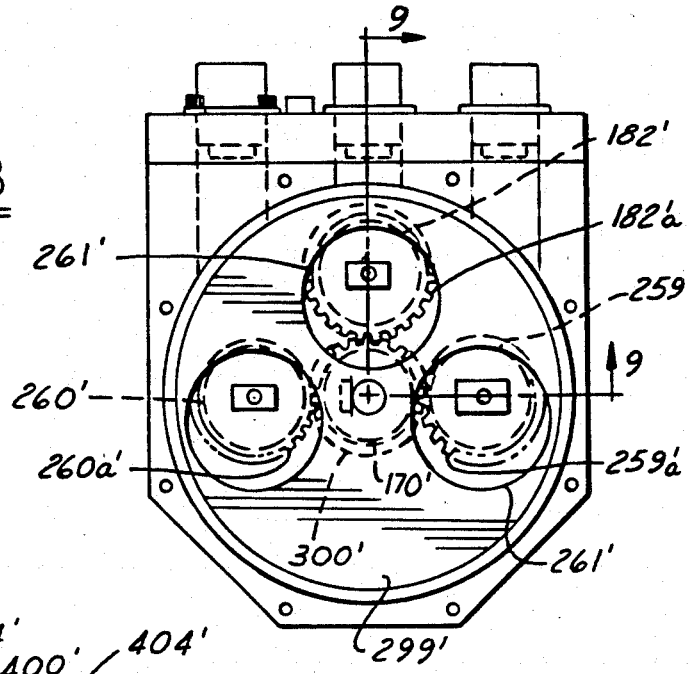
FIG. 8 is a top plan view of the radius setting motor with the top cover removed.

As shown best in FIGS. 6 and 7, dresser arm rotation motor 140' is mounted on plate 123' and depends therefrom. Plate 123' is mounted from housing 130'. The motor 140' drives a pulley 141' that in turn drives a collar 143' on sleeve extension **146*d'* of tubular shaft 146' through a belt 147'. In this way, the coupling 162' is rotated to rotate dresser holder arm 102'** as described hereinabove.

Radius setting motor 170' is mounted in tubular shaft 146' itself rotatably mounted by bearings 150',152'. The output shaft 172' of the motor drives worm gear 174' rotatably supported on holder arm 102' as in the above-described embodiment.

Top plate **146*a'* supports radius setting motor 170' and its associated tachometer 259' and resolver 260'. Plate 146*a'* also supports resolver 182' for motor 140' that drives dresser holder arm 102'. Access holes 261' are provided in plate 299'**.

As tubular shaft 146' is rotated about the pivot axis of arm 102' by belt 147' to incrementally rotate dresser holder arm 102', a gear **182*a'* affixed on an input shaft 182*b'* of resolver 182' rotates around the periphery of a fixed gear 300' in planetary fashion, the fixed gear having its longitudinal axis coaxial with the pivot axis and being fixedly attached to plate 299'. Movement of gear 182*a'* in this manner allows resolver 182' to sense the rotary position of the holder arm 102' for input to computer 62**.

The radius setting motor 170', when actuated to rotate shaft 172', also actuates or drives a gear **170*a'* that is in mesh with driven input gears 259*a'* and 260*a'* on shafts of tachometer 259' and resolver 260' so that the speed and rotary position of the shaft 172' can be sensed for the aforementioned control feedback purposes. Of course, the tachometer 259' interfaces with the respective drive means 262 and the resolvers interface with the computer control 62 as shown in FIG. 5**.

Figure 10:
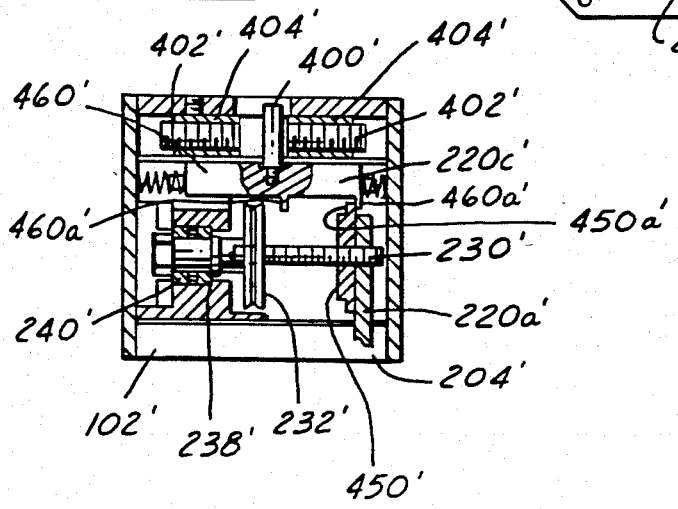
FIG. 10 is a sectional view taken along lines 10—10 of FIG. 9.
Figure 9:
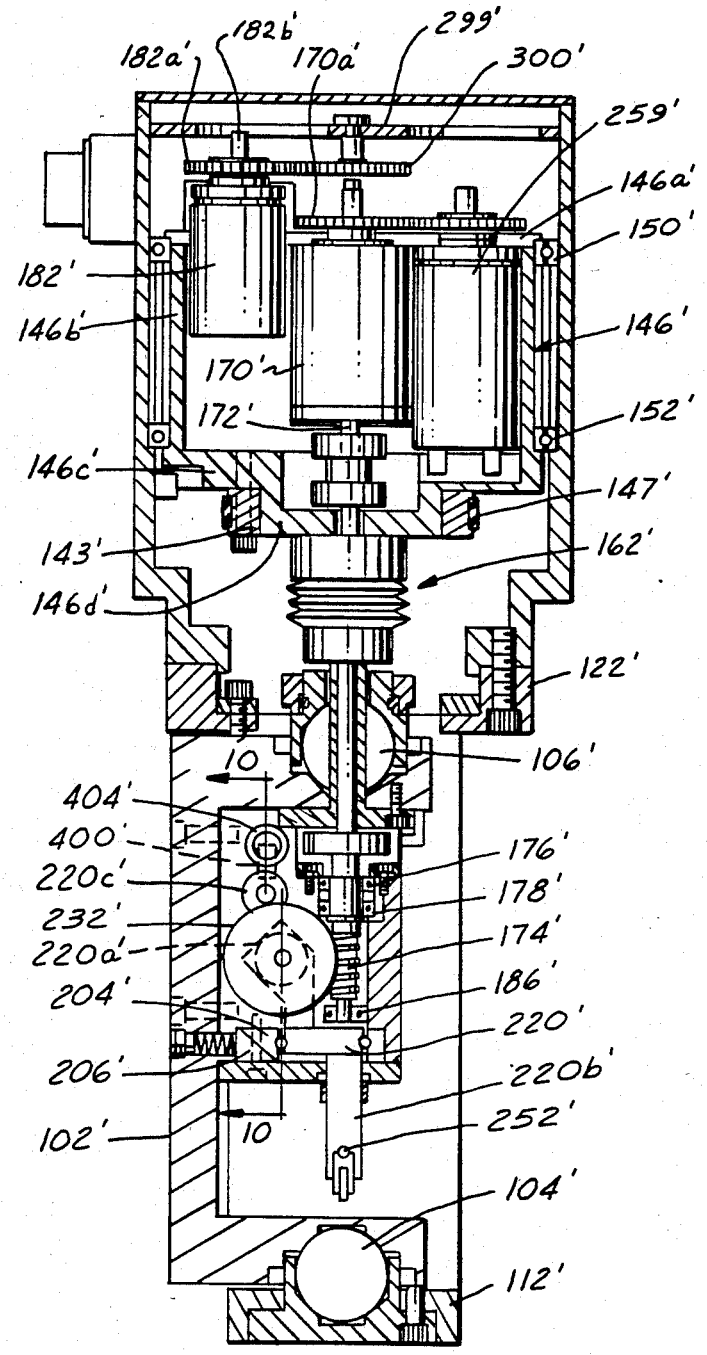
FIG. 9 is a sectional view taken along lines 9—9 of FIG. 8.

In Fig. 10 it is apparent that the carriage member 220' includes an extension **220*a'* that carries a nut 450' with a flange 450*a'* between a pair of projections 460*a'* on shaft 460'. Shaft 460' is movably mounted by springs adjacent opposite shaft ends and carries pin 400' between a pair of proximity position sensors 402' in holder 404'. Movement of carriage 220' at its extreme positions causes flange 450*a'* to contact projections 460*a'* to in turn move pin 400' relative to the sensors. As shown shaft 460' is spring biased at opposite ends to maintain the shaft in a centered position when flange 450*a'* is not engaged to projections 460*a*. Thus, the limits of allowable travel of the carriage 220' on dresser holder arm 102' can be sensed and input to computer 62 for controlling maximum travel of carriage 220' on arm 102'** in the event of incorrect data entry or other malfunction.

Furthermore, different working surface radii and/or shapes on different parts of the same grinding wheel or on different grinding wheels can be dressed automatically in succession by the dresser as automatically repositioned by the computer 62 in accordance with a stored dresser program.

Although certain preferred embodiments of the invention have been described hereinabove and illustrated in the Figures, it is to be understood that modifications and changes may be made therein without departing from the spirit and scope of the invention as defined in the appended claims.

I claim:

1. A dresser apparatus for dressing a radius-defined working surface of a grinding wheel comprising:

(a) a support means, (b) a dresser holder arm that is pivotable on the support means about a pivot axis, (c) a first shaft operably connected to the dresser holder arm, (d) first motor means for rotating the first shaft to pivot the dresser arm, (e) a dresser member mounted on the arm such that pivoting of the arm carries the dresser member along a circular arc path relative to the working face of the grinding wheel to dress same, (f) means for movably mounting the dresser member on the arm for movement relative to the pivot axis to vary the radius of the circular arc path traveled by the dresser member and thus the radius of the working surface dressed on the grinding wheel, (g) a second shaft operably connected to the dresser member through a drive mechanism, (h) second motor means for rotating the second shaft to move the dresser member on the arm through the drive mechanism, said second shaft being coaxial with the first shaft and the first shaft and the second shaft being nested one inside the other, and (i) computer control means for controlling the second motor means in accordance with a stored wheel dresser program that is correlated with workparts to be ground with different radius surfaces by a grinding wheel so as to adjust the position of the dresser member on the arm to dress the same or different grinding wheels with working surfaces defined by different radii.

2. The dresser apparatus of claim 1 wherein the means for movably mounting the dresser member comprises a dresser slide slidably mounted on the arm.

3. The dresser apparatus of claim 2 wherein the dresser slide includes a drive nut and said drive mechanism includes a drive screw rotatably mounted on the arm for rotating relative to the drive nut to translate the dresser slide on the arm.

4. The dresser apparatus of claim 3 wherein the drive screw includes a worm wheel and the second motor means drives a worm gear in mesh with the worm wheel to rotate the drive screw.

5. The dresser apparatus of claim 1 wherein the first motor means is controlled by the computer control means in accordance with the stored dresser program that is correlated with workparts to be ground by the grinding wheel to automatically adjust the degree of pivoting of the arm to successively dress the same or different grinding wheels with working surfaces having different curvatures.

6. The dresser apparatus of claim 1 wherein the first motor means and second motor means are each an electrical motor.

7. The dresser apparatus of claim 1 where the dresser holder arm is pivotably mounted by first and second spherical bearings, said nested first shaft and second output shaft extending through a diametral bore in one of said first and second bearings with the first shaft drivingly connected to the arm and with the second shaft rotatably mounted on the arm.

8. The dresser apparatus of claim 7 wherein the first motor means and second motor means are mounted one above the other in coaxial alignment, the lower of the first motor means and second motor means being disposed inside a tubular portion of the respective first output shaft or second shaft of the first motor means or second motor means thereabove.

9. The dresser apparatus of claim 1 further including servo means for interfacing the computer control means and second motor means, said servo means including position feed back means indicating position of the dresser member relative to the pivot axis.

10. The dresser apparatus of claim 9 further including other servo means for interfacing the computer control means and first motor means, said other servo means including position feedback means indicating of position of the dresser holder arm.

11. The dresser apparatus of claim 1 wherein the first shaft is nested outside said second shaft.

12. The dresser apparatus of claim 11 wherein the first motor means is disposed laterally of the first shaft and is drivingly connected thereto by a drive belt means therebetween.

13. A dresser apparatus for dressing a radius-defined working surface of a grinding wheel comprising:

(a) a support means, (b) a dresser holder arm that is pivotable on the support means about a pivot axis, (c) first motor means for pivoting the dresser holder arm, (d) a tubular drive shaft connected to the dresser holder arm and rotatable by said first motor means, (e) a dresser member mounted on the arm such that pivoting of the arm carries the dresser member along a circular arc path relative to the working face of the grinding wheel to dress same, (f) means for movably mounting the dresser member on the arm for movement relative to the pivot axis to vary the radius of the circular arc path traveled by the dresser member and thus the radius of the working surface dressed on the grinding wheel, (g) second motor means for moving the dresser member on the arm through a drive mechanism therebetween, said second motor means being disposed in the drive shaft, and (h) computer control means for controlling the second motor means in accordance with a stored wheel dresser program that is correlated with workparts to be ground with different radius surfaces by a grinding wheel so as to adjust the position of the dresser member on the arm to dress the same or different grinding wheels with working surfaces defined by different radii.

14. The dresser apparatus of claim 13, wherein the second motor means is disposed on the first shaft for rotation therewith.

15. The dresser apparatus of claim 14 further including a rotary position sensing means for the dresser holder arm, said sensing means being mounted on the first shaft for planetary motion relative to the rotational axis of the first shaft to sense rotary position of the first shaft.

16. The dresser apparatus of claim 15 wherein the sensing means includes a gear that meshes in planetary manner with a fixed gear coaxial with said rotational axis when the first shaft is rotated so that rotation of the planetary gear is sensed by the sensing means.

17. The dresser apparatus of claim 16 wherein the second motor means includes an output gear and a tachometer and resolver each include an input gear that meshes with the output gear of the second motor means to sense its speed and rotary position of the output gear.

* * * * *

UNITED STATES PATENT AND TRADEMARK OFFICE

CERTIFICATE OF CORRECTION

PATENT NO. : 4,805,585

DATED : 2-21-89

INVENTOR(S) : James V. Halvorsen

It is certified that error appears in the above—identified patent and that said Letters Patent is hereby corrected as shown below:

In the specification, column 3, line 51, after "HYAMP" delete "-" and insert —.—. Column 5, line 33, delete "17" and insert —172—.

In the claims, column 9, line 24, delete "output". Column 9, line 33, delete "output".

Signed and Sealed this

Twenty-fourth Day of April, 1990

*Attest:*

HARRY F. MANBECK, JR.

*Attesting Officer*

*Commissioner of Patents and Trademarks*